US007963218B2

(12) United States Patent
Flor

(10) Patent No.: US 7,963,218 B2
(45) **Date of Patent: *Jun. 21, 2011**

(54) SCREW PRESS WITH RADIAL GATE VALVE AND SUPPORTED SCREW SHAFT

(76) Inventor: Derek Flor, La Habra Heights, CA (US)

( * ) Notice: Subject to any disclaimer, the term of this patent is extended or adjusted under 35 U.S.C. 154(b) by 182 days.

This patent is subject to a terminal disclaimer.

(21) Appl. No.: 11/884,041

(22) PCT Filed: Feb. 7, 2006

(86) PCT No.: PCT/US2006/004067

§ 371 (c)(1),
(2), (4) Date: Oct. 27, 2008

(87) PCT Pub. No.: WO2006/086290

PCT Pub. Date: Aug. 17, 2006

(65) Prior Publication Data

US 2009/0211467 A1 Aug. 27, 2009

(51) Int. Cl.
*B30B 9/14* (2006.01)

(52) U.S. Cl. ..... 100/117; 100/148; 100/150

(58) Field of Classification Search ..... 100/110, 100/117, 145, 148, 149; 210/162, 413, 414, 210/767

See application file for complete search history.

(56) References Cited

U.S. PATENT DOCUMENTS 4,121,967 A * 10/1978 Reinhall ..... 162/246
RE31,631 E * 7/1984 McFarland ..... 241/74
7,152,522 B2 * 12/2006 Flor ..... 100/117

* cited by examiner

*Primary Examiner* — Jimmy T Nguyen
(74) *Attorney, Agent, or Firm* — Russo & Duckworth, LLP; David G. Duckworth

(57) ABSTRACT

A screw press is provided having a radial gate valve and supported longitudinally-extending screw shaft. The screw shaft includes a central shaft and helical threads which is driven by a drive package. The screw shaft is encapsulated within a housing including a hopper portion, transition portion, bearing portion and screen portion. A transition portion includes a radial gate valve which is angled such that the radial gate valve's axis of rotation is substantially parallel to the screw shaft threads. In addition, the screw shaft is supported by a first support at its proximal extremity and a second support towards its distal extremity. The support at its distal extremity includes one or more wear bearings which concentrically support the threads of the screw shaft in a frictional engagement manner. Back flow of material is prevented by a radial gate valve. The angle of the radial gate valve with respect to the screw presses housing provides for greater pressure build up within the screen portion. Moreover, the use of wear bearings reduces wear to the housing and screen due to metal on metal contact with the screw threads and also provides for increased efficiency of the screw press operation.

5 Claims, 3 Drawing Sheets

SCREW PRESS WITH RADIAL GATE VALVE AND SUPPORTED SCREW SHAFT

This is a National Phase of PCT/US2006/004067 filed on Feb. 7, 2006, which in turn claims priority to U.S. patent application Ser. No. 11/054,151 filed on Feb. 8, 2005, now U.S. Pat. No. 7,152,522 issued on Dec. 26, 2006.

BACKGROUND OF THE INVENTION

The present invention relates generally to screw presses for extracting liquids from semi-solids. More particularly, the present invention is directed to an improved screw press for the mechanical separation of liquids from semi-solid material. The invention is believed to have particular application to the extraction of liquids from manure. However, the screw press of the present invention is believed to also have application to the extraction of liquids from a wide variety of materials, such as the extraction of liquids from fruits or vegetables, the pressing of grapes within the wine industry, and the processing of garbage and trash for reducing the volume thereof.

Presses suitable for the extraction of liquids from semi-solid materials have been known for a very long time, and there are various press structures that have been utilized. The most popular is the screw press. Screw presses include longitudinally extending shafts having enlarged threads. The shaft and screw are encased within a housing. Screw presses work because the rotation of the shaft and threads causes materials to be conveyed through the housing to a restriction. The restriction, also commonly referred to as a strainer, includes an orifice, cone, mesh or screen. Because screens are one of the more popular straining devices and considered most useful for application of the present invention, screw presses will be described herein as including a screen restriction. However, other restrictions may be also utilized in the practice of the present invention.

In operation, the screw press forces the semi-solid material towards the screen causing the material to compress and squeeze liquid through the screen openings for capturing in a large tank or other container. Some screw presses use a variable decreasing thread also referred to as a flight, to compress the material between the threads. Unfortunately, these types of presses are prone to the machinery jamming because too much material can be compressed between the flights restricting rotation of the shaft. Moreover, the material's "head" can be too full of moisture content to act as a plug at the discharge restriction. Variable flight designs also place a lot of radial pressure on the screens which can shorten the screen's life.

Still additional problems have been encountered with cantilevered screw presses. In a cantilevered press, the screw is driven from the drive end but has no support at the discharge end. The discharge end will typically include a closed door immediately past the screen. Material introduced to the feed screw is carried forward and built up in the screen chamber and forced against the screen and closed door. Once the cake is built up, material continues to be fed into the cantilevered presses causing liquids to be squeezed out of the cake and passed through the screen. Unfortunately, the weight of the screw shaft can cause the shaft to bend causing the screw threads to engage the screen and/or interior housing. Moreover, it is extremely difficult to engineer a screw shaft to be perfectly parallel to its annular housing which also causes the screw threads to engage the housing and/or screens. Because the screw threads, housing and screens are typically made of metal, this results in a metal-to-metal contact creating significant noise, wear and friction which hinders rotation of the screw shaft. The cantilevered screw press has another shortcoming in that excessive pressure at the discharge end requires a high rate of shaft revolution which can cause significant wear to the screw press components, or requires a long screw to separate the high pressure end from the low pressure end causing a long and costly design. Moreover, an equilibrium pressure will often occur somewhere along the shaft causing the high pressure end of the shaft to push or pull back towards the inlet and cause the inlet to fill with the semi-solid material. This will inhibit the proper movement of material toward the high pressure side of the press. The material will then just "roll" with the rotation of the screw between the screw threads.

To overcome some of these problems, screw presses will sometimes employ a radial gate valve, also referred to as a "star wheel", to inhibit back-flow of material in the press. The radial gate valve includes a plurality of teeth which project into the interstitial spaces between the screw's threads which inhibit the back-flow of material. Unfortunately, radial gate valves are expensive to manufacture and often do not impart sufficient force upon the material to completely prevent material back-flow.

Still additional screw press designs limit the amount of pressure at the material head and, consequently, less liquid is removed from the product before the solid material is pressed and discharged. In order to counter these problems, it has been known to use "super chargers" which build pressure within the inlet of the screw press to force material through the screw press to increase head pressure. These supercharged screw presses also reduce the tendency of material to back-flow towards the inlet which can stop all production. Thus, there are significant disadvantages with all prior screw press designs.

Therefore, it is an object of the present invention to provide an improved screw press which increases the liquid extraction from semi-solid materials.

It is still an additional object of the present invention to provide an improved screw press which reduces wear to components structures.

It would be an additional object of the present invention to provide an improved screw press which is inexpensive to manufacture, simple to operate and less prone to breakdowns.

These and other objects, features and advantages of the present invention will be apparent from the following written description which follows.

SUMMARY OF THE INVENTION

Briefly, the screw press of the present invention includes a longitudinally extending screw-shaft including the shaft itself, as well as the screw threads which are concentrically and spirally affixed around the shaft. The threads extend a substantial portion of the length of the shaft and may include a fixed pitch throughout the shaft's length or the pitch may be variable to increase pressure along its length.

The screw press of the present invention further includes a motor for rotating the screw shaft. The motor may be any type as can be selected by those skilled in the art, such as gas or electric powered. In addition, the screw press includes a housing for encasing the screw shaft. The housing includes an opening for allowing the shafts proximal extremity to project through the housing to engage the motor. Furthermore, the housing includes an inlet for the introduction of semi-solid material to be pressed, as well as outlets for the discharge of fluids and substantially solid materials. To this end, the housing includes a screen which is positioned at the distal end of the screw shaft for the discharge of liquids. In addition, the housing includes an openable and closeable discharge door positioned distal to the screen for selectively discharging the substantially solid material.

The screw press of the present invention further includes additional structures and modifications which improve efficiency, reduce wear and reduce the cost of the assembly. In particular, the screw shaft is preferably not cantilevered to ensure that the screw shaft is concentrically aligned within the housing throughout the shaft rotation. To this end, the shaft includes a first support for supporting the shaft at its proximal end, in similar manner to a cantilevered shaft. This can be accomplished by various means. For example, the mounting of the shaft to the motor can provide sufficient support for the shaft at its proximal extremity. Alternatively, the assembly may include a bearing mount which is supported by any number of fixtures to maintain support for the proximal extremity of the screw shaft.

In addition to the proximal support, the screw shaft is supported by a second support located toward the screw shaft's distal extremity, but proximal to screw press' filtration screen. This second support structure includes one or more "wear" bearings which are located within the screw press' housing. The wear bearings are annular structures having an inner diameter substantially the same or only slightly greater than the diameter of the screw threads. The screw shafts and threads are concentrically positioned within the wear bearing so that the threads reside upon and are supported by the wear bearings. The wear bearings prevent a radial movement of the screw shaft thereby reducing wear to the screens and housing. Moreover, the introduction of the wear bearings enables the housing and screw shaft to be manufactured to more exacting standards to provide increased pressure throughout the screw press process. The wear bearings may be manufactured from various low friction materials including metals. However, it is preferred that the wear bearings be manufactured from durable low-friction plastic materials including ultra-high molecular weight (UHMW) plastic.

The screw press of the present invention preferably also includes a radial gate valve, commonly referred to as a star wheel. The radial gate valve includes a circular body and a plurality of teeth. In a preferred embodiment, the radial gate valve includes ten teeth. The radial gate valve is positioned to project through a slot formed in the screw press' housing so that one or more teeth project into the interstitial spaces formed between the screw threads. The radial gate valve is rotatably mounted so that it rotates freely about its center, defining its axis of rotation. Moreover, the substantially circular, or wheel-like structure of the radial gate valve defines its "plane of rotation". The rotatable gate valve is rotated by rotation of the shaft in similar manner to a traditional helical screw and toothed gear mechanism. Meanwhile, the teeth are sized to substantially fill the spaces between threads so as to prevent back-flow of material as it is conveyed through the housing by rotation of the screw shaft.

Advantageously, unlike previous screw press designs, the radial gate valve is not positioned so that its axis of rotation is perpendicular to the screw shaft's longitudinal axis which would require that the valve's teeth be angled to coincide with the pitch of the screw threads. Instead, the radial gate valve of the present invention is preferably positioned at an angle relative to the screw shaft so that the radial gate valves' axis of rotation is substantially parallel to the angle of the screw threads.

Advantageously, positioning the radial gate valve at an angle relative to the screw-shaft's longitudinal axis allows the radial gate valve to be manufactured without angled teeth which are far more costly to manufacture. In addition, it has been found that the radial gate valve can be manufactured to tighter tolerances resulting in smaller spaces between the gate valve and screw threads which results in less wear and increased compression of material within the screw press' housing. The radial gate valve may be manufactured of various materials. However, it is preferred that the radial gate valve be manufactured of a plastic such as high molecular weight (UHMW) plastic.

It is thus an object of the present invention to provide an improved screw press which reduces metal-on-metal wear between the screw threads and screen.

It is an additional object of the present invention to provide an improved screw press which increases the liquid extraction from semi-solid materials.

It is still an additional object of the present invention to provide a screw press which is less expensive to manufacture and requires less maintenance.

Moreover, it is an object of the present invention to provide a screw press which is less susceptible to jamming due to back flow or other disabling conditions prevalent to screw press designs.

These and other and more specific objects and advantages of the invention will be apparent to those skilled in the art from the following detailed description taken in conjunction with the drawings.

DETAILED DESCRIPTION OF THE INVENTION

Figure 1:
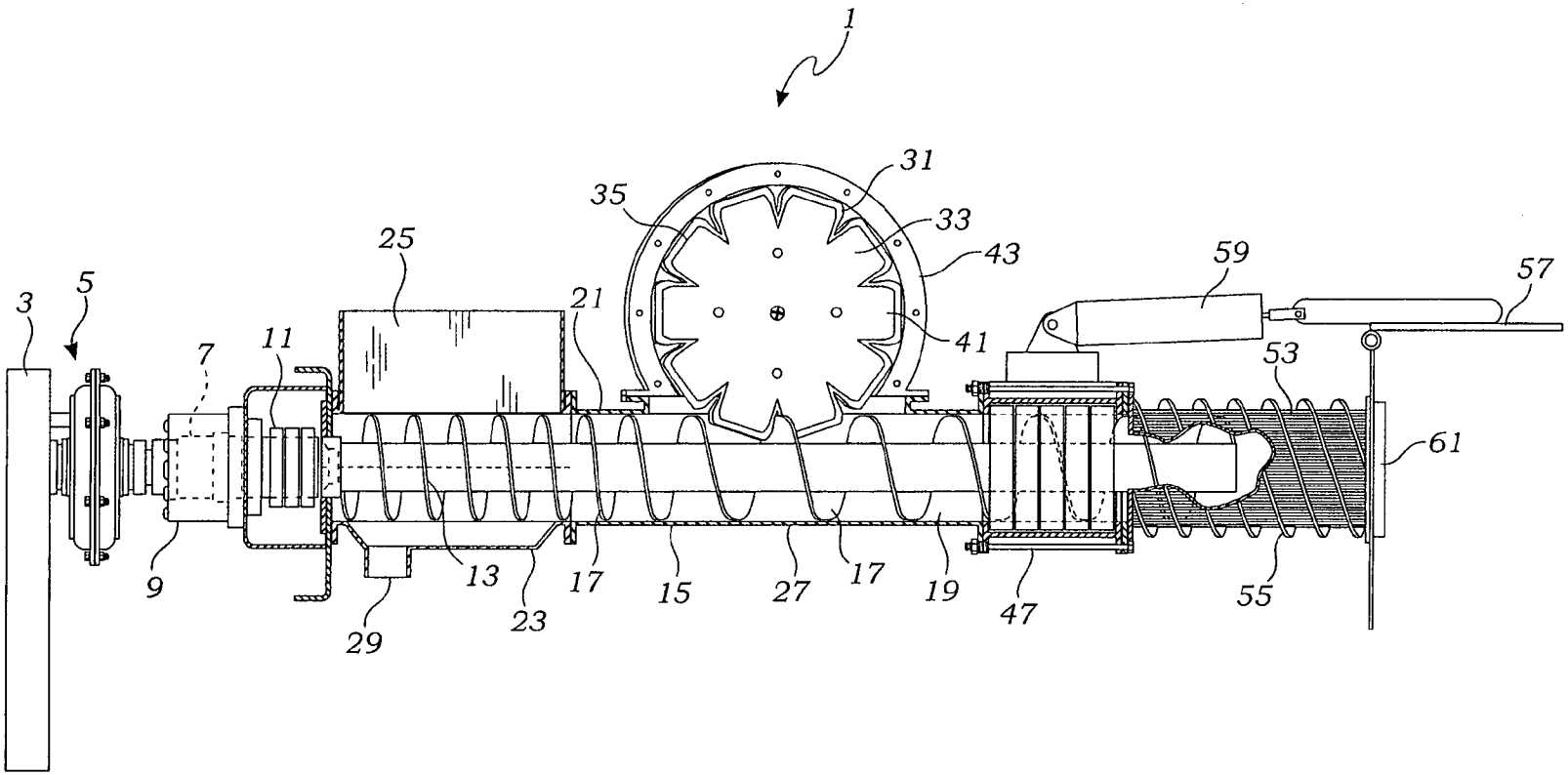
FIG. 1 is a side view illustrating the screw press of the present invention.

While the present invention is susceptible of embodiment in various forms, there is shown in the drawings and will hereinafter be described the presently preferred embodiments of the invention with the understanding that the present disclosure is to be considered as an exemplification of the invention and it is not intended to limit the invention to the specific embodiments illustrated.

Figure 4:
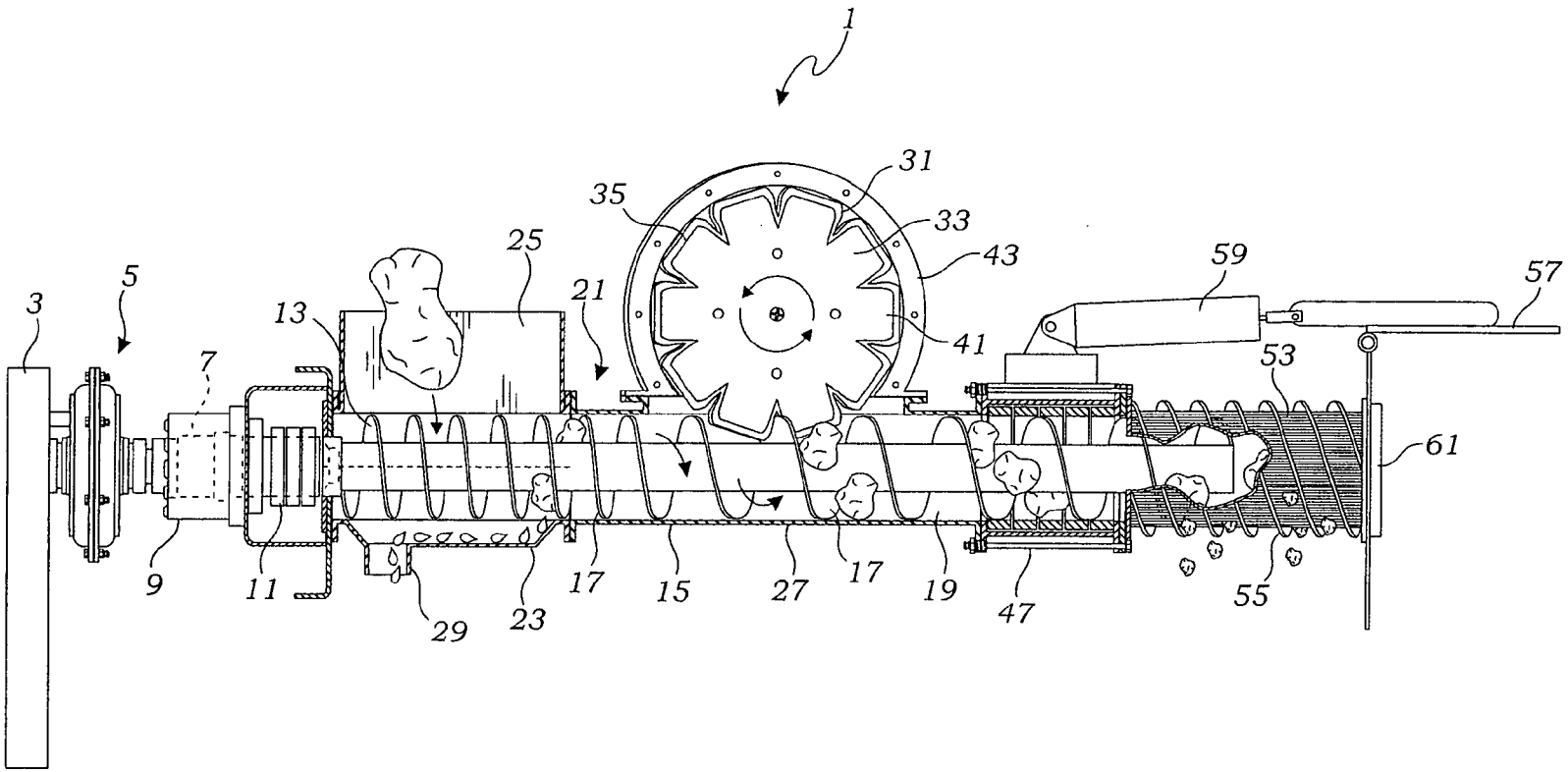
FIG. 4 is a side view of the screw press of the present invention illustrating its operation.

With reference to the Figures, the screw press 1 of the present invention includes a longitudinally-extending rotating screw shaft 13. The screw shaft 13 includes a central shaft 15 and helically-mounted threads 17. The screw shaft is supported by a support assembly 3 at its proximal extremity. In addition, the screw shaft is rotated by a drive package 5 which may include a gas, diesel or electric driven motor. The screw shaft's central shaft 15 may be constructed in one piece. Alternatively, as shown in FIGS. 1 and 4, the screw shaft may include a first portion 7 which connects directly to the motor at one end and is affixed to a second portion of the shaft 15 by use of a collar 11 at its other end. In a preferred embodiment, the screw press includes a thrust bearing 9 for preventing unwanted axial movement of the screw shaft during operation.

The screw press 1 of the present invention also includes a housing 21 which extends substantially the entire length of the screw shaft 13. As shown in FIGS. 1 and 4, the housing consists of four distinct portions including a hopper portion 23, a transition portion 27, a bearing portion 47 and a screen portion 53. The hopper portion includes an inlet 25 for receipt of pre-processed semi-solid materials. In addition, the hopper portion 23 includes a drain 29 for the draining of liquids in the event that the semi-solid materials are particularly saturated with liquid. The transition portion 27 of the housing preferably includes a cylindrical interior chamber having an inner diameter only slightly larger than the outer diameter of the screw threads 17. In addition, the transition portion includes a radial gate valve 31 having a substantially circular center body portion 33 and a plurality of teeth 35. The radial gate valve is preferably made of a plastic material such as high molecular weight (UHMW) plastic which is reinforced by a plate 41. The plate may be made of any number of materials. However, it is preferred that it is made of a corrosion-resistant metal due to the environment within the screw press housing.

As shown in the Figures, the radial gate valve 31 resides within a housing 43 formed on top of the transition housing portion 27. The housing 43 includes an opening at its bottom side so that the radial gate valve's teeth 35 project into the transition portion 27 of the housing and into the interstitial spaces 19 formed between the screw threads. Preferably, the radial gate valve and teeth are constructed so that the teeth substantially block the interstitial spaces 19 during rotation of the screw shaft and radial gate valve to inhibit back-flow of material as it is conveyed downstream through the screw press housing.

Of importance, the radial gate valve 31 and radial gate valve housing 43 are affixed at an angle relative to the longitudinal axis of the screw shaft 13 and primary housing 21 so that a radial gate valve's axis of rotation is substantially parallel to the angle of the screw threads. Correspondingly, this causes the radial gate valve's plane of rotation 39 to be substantially perpendicular to the screw threads. Of course, the angle of the radial gate valve relative to the screw shaft may vary greatly depending on the diameter and pitch of the threads of the screw shaft which may vary depending upon various factors such as the rate and percentage of moisture extractions and material to be pressed. For example, a preferred screw press with screw threads having a four inch pitch and six inch diameter will preferably include a radial gate valve positioned so that its plane of rotation is angled 12-14 degrees from the screw-shaft's longitudinal axis.

Constructing a screw press with an angled radial gate valve provides several advantages. First, the radial gate valve is less expensive to manufacture as the teeth do not need to be angled. In addition, it has been found that the radial gate valve is better capable of withstanding the back loads imparted by material attempting to move backward within the screw press housing. Furthermore, the radial gate valve can be manufactured to closer tolerances providing greater impedance to back flow.

Figure 2:
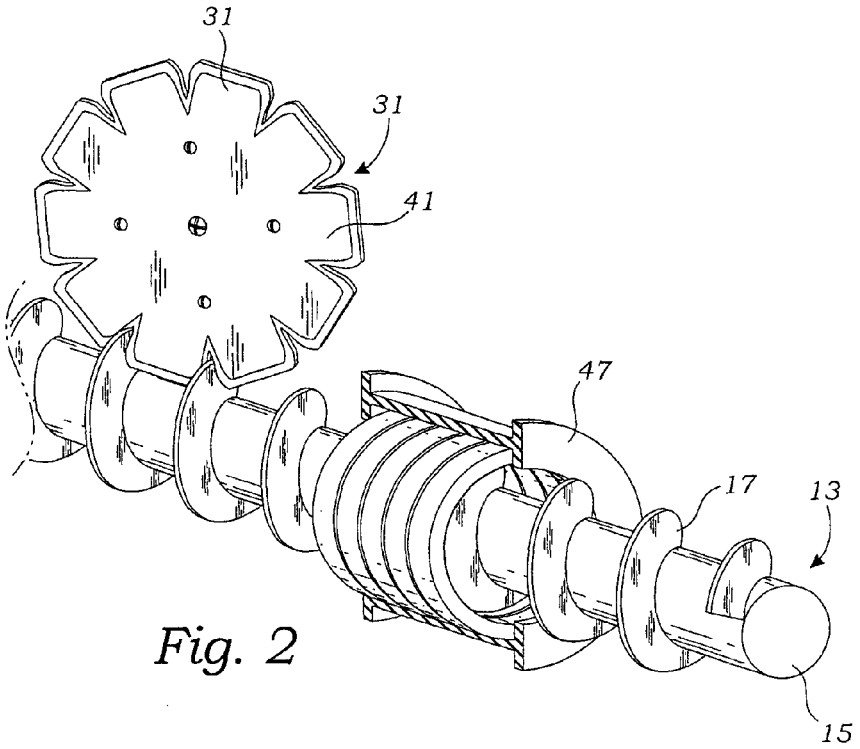
FIG. 2 is a perspective view illustrating the angled radial gate valve of the present invention and bearing support of the present invention.
Figure 3:
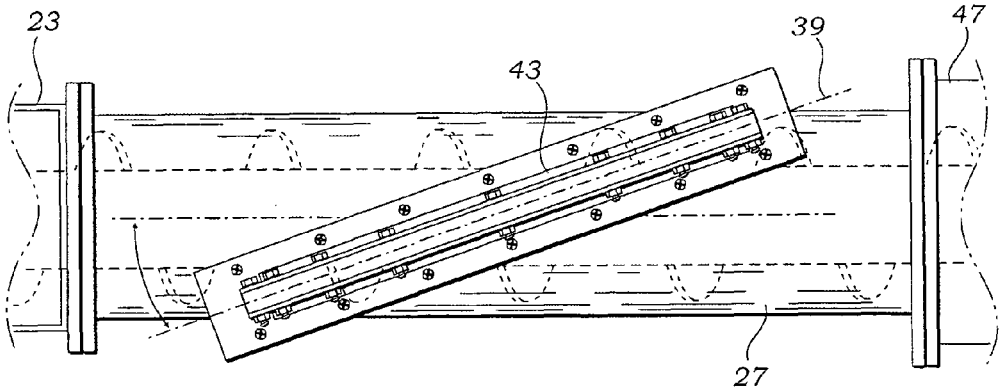
FIG. 3 is a top view illustrating the angled feature of the radial gate valve of the present invention.

An additional advantage of the present invention is the implementation of "wear" bearings for supporting the screw shaft towards its distal extremity. To this end, as shown in FIGS. 1, 2 and 4, the housing 21 includes a bearing portion 47 for storing one or more annularly shaped bearings. Though the screw press may utilize any number of wear bearings, as shown in the Figures, five "wear" bearings are positioned within the cylindrical interior of the bearing housing for concentrically supporting and positioning the threads 17 of the screw shaft. Because the wear bearings provide frictional engagement and support for the screw shaft threads, preferably the wear bearings are made from a low friction material such as ultra high molecular weight (UHMW) plastic. Because the wear bearings will ultimately have to be replaced due to friction between the screw threads and the interior surface of the bearings, preferably the bearing housing 37 can be easily disassembled and assembled to facilitate bearing replacement. Constructions for such bearing housings can be implemented by those skilled in the art without undue experimentation.

The screen 53 comprises the final portion of the housing 21. The screen encapsulates the distal extremity of the screw shaft and includes mesh openings sized to allow liquids to seep through but prevent solid material from escaping. In a preferred embodiment, the screen is wrapped with one or more helical screen stiffeners 55. Any number of helical screen stiffener's may be utilized which will increase the screen's resistance to bulging and bursting due to internal pressures.

The housing further includes an opening 61 for the release of solid material which is closed by a door 57. The door is controlled by a pneumatic controller 59 which causes the door to open upon pressure within the screen reaching a pre-determined amount. Again, suitable door assemblies can be constructed by those skilled in the art without undue experimentation.

With reference to FIG. 4, in operation, semi-solid materials are introduced into the hopper portions inlet 25, allowing any excess liquid to drain through drain 29. The semi-solid materials are then conveyed by rotation of the screw threads towards the screw shaft's distal extremity. The screw threads may have a fixed pitch. However as shown in the Figures, preferably the threads have a variable pitch to increase pressure towards the shaft's distal extremity. Semi-solid material will continue to be conveyed by rotation of the screw threads until sufficient material has collected within the screen portion 53 so that material will compress against the screen 53 and door 57. Further compression of the semi-solid material causes the release and extraction of liquids through the screen. Any propensity for back-flow is prevented by the radial gate valve's teeth blocking the interstitial spaces between the screw threads. Once sufficient pressure has reached a predetermined level within the screen portion suggesting sufficient liquid extraction from the semi-solid material, the door 57 is manually or automatically opened to allow release of the now substantially solid material from the screen portion.

Although particular preferred embodiments of the invention have been described herein, it is to be understood that variations may be made in the construction, materials and shape of the screw press without departing from the spirit and scope of the invention. Having described the invention in such terms to enable those skilled in the art to make and use it, and having identified the presently preferred embodiments thereof,

I claim:

1. A screw press for compressing a combination of solid and liquid matter, the screw press comprising:

a rotatable longitudinally extending shaft having a proximal end and a distal end;

screw threads concentrically positioned and affixed around said shaft and extending a substantial portion along the length of said shaft, the rotation of said shaft and threads conveying material from the proximal end of said shaft to the distal end of said shaft;

a motor for rotating said shaft and said screw threads;

a housing for encasing a substantial portion of said shaft and screw threads, said housing including an inlet located for the introduction of material to said screw threads and an outlet for the discharge of liquids, said outlet being a screen positioned at said distal end of said shaft, the rotation of said screw threads causing material to be conveyed from the proximal end of said shaft to the distal end of said shaft to compress material against said screen to discharge fluids through said screen;

a first support means for supporting said shaft at its proximal end; and a second support means for supporting said shaft, said second support means located within said housing proximal and substantially adjacent to said screen, said second support means including one of more replaceable annularly shaped low friction wear bearings made of plastic which engage and support said screw threads to support said shaft.

2. The screw press of claim 1 wherein said wear bearings are made of ultra high molecular weight (UHMW) plastic.

3. The screw press of claim 1 further comprising an openable and closeable discharge door adjacent and distal to said screen for selectively discharging substantially solid material.

4. The screw press of claim 1 further comprising a rotatable radial gate valve including a body, a plurality of teeth, and an axis of rotation about which said radial gate valve rotates, said body and said teeth further defining the rotatable gate valve's plane of rotation within which said rotatable gate valve rotates, said rotatable gate valve positioned with one or more of said plurality of teeth positioned between threads to inhibit the back flow of material through said screw threads when said shaft and screw threads are rotated, said radial gate valve also being positioned with its plane of rotation angled relative to said shaft's longitudinal axis so that said axis of rotation is not perpendicular to said shaft's longitudinal axis.

5. The screw press of claim 4 wherein said radial gate valve's plane of rotation is substantially perpendicular and said axis of rotation substantially parallel to said screw threads.

* * * * *